US005310181A

United States Patent [19]

Chan

[11] Patent Number: 5,310,181

[45] Date of Patent: May 10, 1994

[54] RACQUET STRING ALIGNER

[76] Inventor: Stephen Chan, 2800 Ingleton Avenue, Burnaby, British Columbia, Canada, V5C 6G7

[21] Appl. No.: 963,919

[22] Filed: Oct. 20, 1992

[51] Int. Cl.[5] ..... A63B 51/14

[52] U.S. Cl. ..... 273/73 R

[58] Field of Search ..... 273/73 R, 73 A, 73 D

[56] References Cited

U.S. PATENT DOCUMENTS

| | | | |
|---|---|---|---|
| 4,089,523 | 5/1978 | Newberger et al. . | |
| 4,489,942 | 12/1984 | Kent . | |
| 4,733,866 | 3/1988 | Herbert . | |
| 4,752,071 | 6/1988 | Tabach . | |
| 4,776,591 | 10/1988 | Ho | 273/73 R |
| 4,989,864 | 2/1991 | Ubl . | |
| 5,035,429 | 7/1991 | Redrow . | |

FOREIGN PATENT DOCUMENTS

| | | | |
|---|---|---|---|
| 3135521 | 3/1983 | Fed. Rep. of Germany | 273/73 A |
| 3337341 | 4/1984 | Fed. Rep. of Germany | 273/73 A |
| 2616669 | 12/1988 | France | 273/73 D |
| 2620945 | 3/1989 | France | 273/73 D |
| 2641700 | 7/1990 | France | 273/73 D |
| 2661102 | 10/1991 | France | 273/73 D |
| 92/010243 | 6/1992 | World Int. Prop. O. | 273/73 D |

*Primary Examiner*—Vincent Millin
*Assistant Examiner*—Raleigh W. Chiu
*Attorney, Agent, or Firm*—Oyen Wiggs Green & Mutala

[57] ABSTRACT

This invention pertains to a novel aligner which can be used to space evenly the strings of a sports racquet. More particularly, this invention pertains to a novel racquet string aligner which can accommodate different racquet string spacings and can be used as the cap for a typical container for tennis balls. A racquet string aligner for aligning the strings of a racquet comprising: (a) a base member; (b) a tapered central projection on the base member having a topography that tapers away from the base member; (c) at least one tapered first projection adjacent the central projection the base of which is located a first radius from the center-point of the central projection, and at least a portion of the upper surface of which has a first slope in the direction of the central projection; and (d) at least one tapered second projection the base of which is located at a second radius from the center-point of the central projection greater than that of the first radius and at least a portion of the upper surface of which slopes in the same direction as the slope of the first projection in the direction of the central projection to a degree smaller than the first slope.

11 Claims, 5 Drawing Sheets

RACQUET STRING ALIGNER

FIELD OF THE INVENTION

This invention pertains to a novel aligner which can be used to space evenly the strings of a sports racquet. More particularly, this invention pertains to a novel racquet string aligner which can accommodate different racquet string spacings and can be used as the cap for a container for tennis balls.

BACKGROUND OF THE INVENTION

The strings of a sports racquet, such as a tennis racquet or a squash racquet, are constantly moving out of alignment, particularly in situations where the player has a powerful stroke and hits the ball hard. Upon impact, the strings impacting the ball move out of alignment and thus the spacing between the strings becomes irregular. It is typical to see world ranked tennis players, for instance, constantly hand moving the strings of their racquets, and particularly the strings of the "sweet spot" in the central area of the racquet, back into alignment between the times when the ball is in play.

A number of patents and design patents have been issued over the years disclosing and protecting various types of racquet string aligners.

U.S. Pat. No. 4,089,523, Newberger et al., granted May 16, 1978, discloses an aligning tool for realigning misaligned strings in the central zone of the string network of a racquet after heavy use. The tool includes a plurality of spaced pyramidal projections extending from a base. The tool projections are adapted to be inserted between the strings and force misaligned strings in the racquet back to a normal aligned condition.

The Newberger et al. string aligning tool is designed to accommodate only one racquet string spacing size. Moreover, the truncated pyramids on the Newberger et al. aligner contact only every second string. The Newberger et al. tool cannot be used as the top cover for a container of tennis balls.

U.S. Pat. No. 4,489,942, Kent, granted Dec. 25, 1984, discloses a device for aligning strings in the grid of a tennis racquet. The device is comprised of a base which has a peripheral groove for receiving the frame of the racquet. The base has a plurality of posts arranged and shaped to intersect the spaces between strings. A cover is hinged to the base and acts as a press to force the tennis racquet down on the posts, causing mislocated strings to become aligned.

In Kent's racquet string aligner, the spacing posts are of a conical shape and must correspond precisely in spatial arrangement with the spaces between the strings of the racquet. Kent also discloses a cover which can be pressed over the racquet and force the strings down onto the tapered posts, which are held on a platform. Kent cannot deal with different string spacings or be used as a tennis ball can cover.

U.S. Pat. No. 4,733,866, Herbert, granted Mar. 29, 1988, discloses a portable string aligner for tennis racquets, racquetball racquets, and for other games in which a racquet is used. The aligner combines an elongated rectangular base member with multiple spacing pegs removably fitted in a retainer track. The spacing-peg tops protruding externally through a track opening in one surface of the base member are of sufficient length and are shaped to fit through the squares formed by the vertical and horizontal cross-over of the racquet strings in a strung racquet head. By hand pressuring the spacing pegs through the racquet string squares, the racquet strings can be restored to proper alignment.

The Herbert racquet string aligner comprises only one row of spacing pegs for re-spacing the racquet strings. The Herbert racquet string aligner has no capacity to handle a range of racquet string spacings. The design of the Herbert string aligner does not permit it to be used as the cap for a can of tennis balls.

U.S. Pat. No. 4,752,071, Tabach, granted Jun. 21, 1988, discloses a method for realigning strings in a stringed racquet by using a device which has an elongated rigid member and a hook. Tabach aligns only one string in a racquet at a time. There is no capability of aligning all of the strings in the racquet in unison. The device cannot be used as a container cover.

U.S. Pat. No. 4,776,591, Ho, discloses a comb-like portable racquet string straightener which has an elongated holder and a straight row of unconnected teeth mounted in parallel arrangement along the holder. Each tooth has at the free end thereof a string receiving notch which is adapted to engage the strings of a tennis racquet. Ho does not disclose multiple rows of projections for aligning the racquet strings. Moreover, Ho does not disclose any capability of handling assorted string spacings, or the use of the straightener as a tennis ball container lid.

U.S. Pat. No. 4,989,864, Ubl, granted Feb. 5, 1991, discloses a racquet string straightening device which comprises a support, one face of which has projecting therefrom a fixed array of teeth. The teeth are arranged in rows with passages therebetween to receive the strings of a racquet. In a second embodiment, alternate teeth may be omitted. Each tooth has a body of rectangular cross-section defined by pairs of parallel sides and a tapered outer end to facilitate entry of each tooth into the respective openings in the strings.

In the Ubl racquet string straightener, the string aligning projections are rectangular blocks with pyramid tops which cannot accommodate different string spacings. Moreover, the Ubl straightener is designed to fit over the entire racquet string area of the racquet face. The spacing between the blocks and the racquet strings must correspond precisely. The Ubl straightener is not suitable for combining with a container of tennis balls.

U.S. Pat. No. 5,035,429, Redrow, granted Jul. 30, 1991, discloses a racquet string straightener that fits onto and co-acts with the strings in the head of a tennis racquet. The string straightener resembles a hair comb. The projections for aligning the strings are distributed in a row. The teeth are held on a substantially rigid body. The straightener cannot accommodate different string spacings or be used as a cover or lid for a tennis ball container.

SUMMARY OF THE INVENTION

The invention is directed to a racquet string aligner for aligning the strings of a racquet comprising: (a) a base member; (b) a tapered central projection on the base member having a topography that tapers away from the base member; (c) at least one tapered first projection adjacent the central projection the base of which is located at a first radius from the centre point of the central projection, and at least a portion of the string impinging surface of which has a first slope in the direction of the central projection; and (d) at least one tapered second projection the base of which is located at a second radius from the centre point of the central projection greater than that of the first radius, at least a portion of the outer surface of which slopes in the same direction as the slope of the first projection in the direction of the central members to a degree smaller than the first slope.

The aligner may include at least one tapered third projection the base of which is located at a third radius from the centre-point of the central projection greater than the second radius and at least a portion of the outer surface of which slopes in the same direction as the slopes of the first and second projection in the direction of the central member to a degree smaller than the slope of the second projection. The base member of the aligner may be circular.

A racquet string aligner for aligning the strings of a racquet to provide even spaces between the strings comprising: (a) a circular base member; (b) a central row of first projections extending upwardly from the base along a centre-line of the circular base member; and (c) a pair of rows of second projections extending upwardly from the circular base member and distributed parallel to and in spatial arrangement on either side of the central row of projections and the centre-line of the circular base member, the outer slopes of the second projections slanting in the direction of the centre-line, to accommodate racquets with smaller string spacing while the bases of the projections accommodate racquets with larger string spacing.

In the aligner as defined, a pair of rows of third projections extending upwardly from the circular base member may be distributed parallel to and in spatial arrangement with the pair of rows of upwardly extending second projections, and may be disposed on the sides of the respective rows of second projections, opposite the central row of first projections, the five rows of upwardly extending first, second and third projections having outer sides, which slope to the centre area of the circular base member and thereby proportionately accommodate at different elevations along the slopes of the projections racquet strings of progressively smaller spacings.

The central row of first projections (b) may have four projections in the row, the two intermediate rows of second projections may have four projections in each row with outer slopes leaning toward the centre-line to a first degree, and the two outer rows of third projections may have three projections in each row with outer slopes leaning toward the centre-line to a degree smaller than the first degree.

The circular base of the aligner may have extending downwardly therefrom around its periphery a skirt which is adapted to releasably engage with the top rim of a hollow cylindrical container adapted to hold at least one tennis ball.

The upwardly extending projections may have rounded corner square bases, the two outer rows of third projections may be slanted upwardly and inwardly in the direction of the centre row of first projections, and the two intermediate rows of second projections may be slanted upwardly and inwardly in the direction of the centre row of first projections, but at a lesser angle than the slope of the two outer third projections.

The walls of the projection at the centre-point of the aligner in the first row of projections may slope symmetrically and inwardly along an axis extending vertically from the circular base member, and the outer walls of the first projections on either side of the central symmetrical projection may slope inwardly in the direction of the central symmetrical projection.

In the aligner, an elongated tab may be connected to one side of the periphery of the skirt extending downwardly from the circular base member. The bases of the upwardly extending projections may be square.

The invention is also directed to a racquet string aligner and tennis ball container lid combination comprising: (a) an racquet string aligner with a circular base having a skirt around the circumference thereof and (b) a hollow cylindrical container adapted to contain tennis balls, the top rim of the hollow cylinder being adapted to releasably engage with the skirt of the circular base of the aligner.

In the combination as defined, the circular base of the aligner may have threads therein which are adapted to releasably engage with mating threads around the top aligner engaging rim of the hollow cylindrical container.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
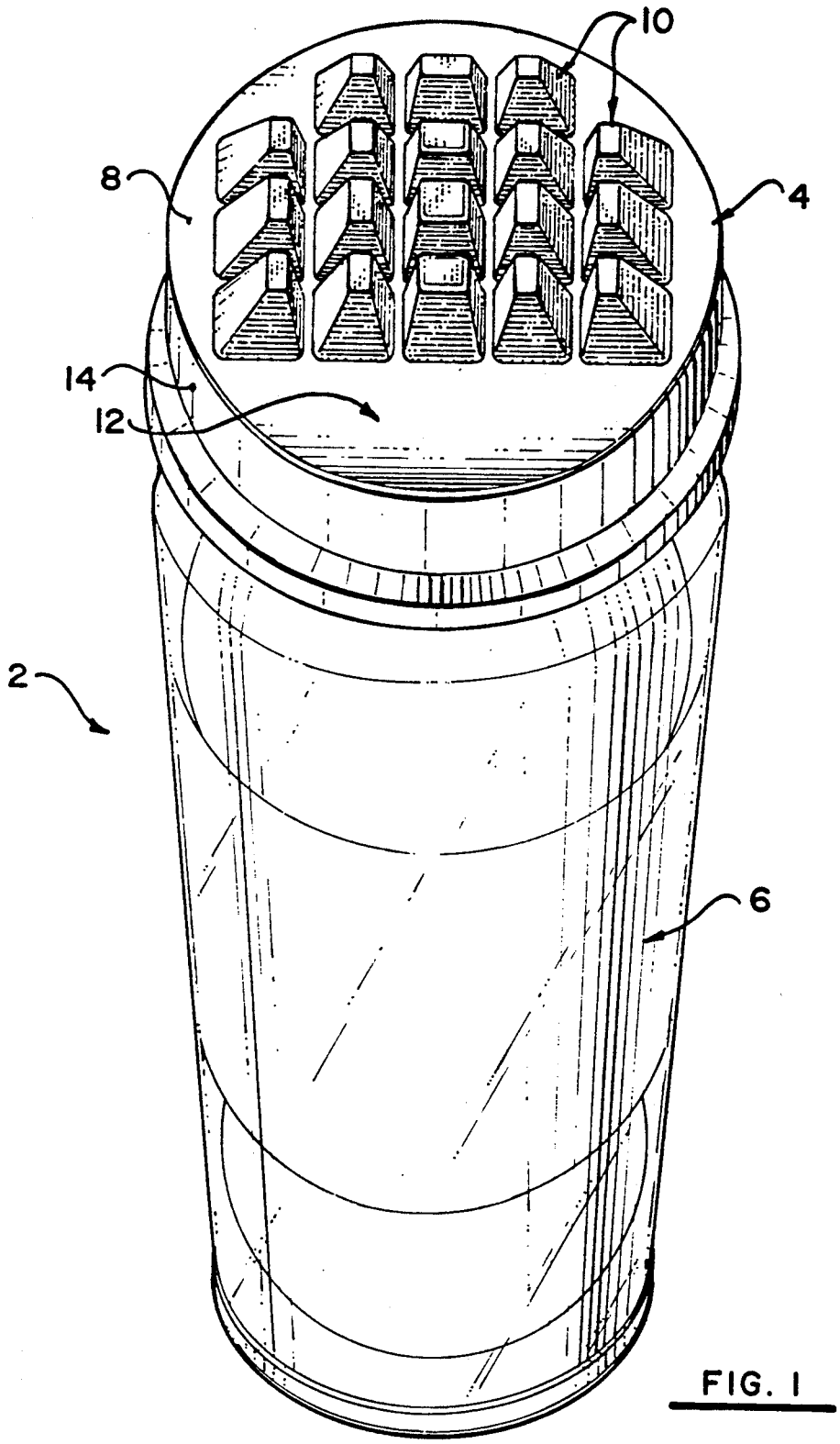
FIG. 1 illustrates an isometric view of a racquet string aligner mounted as the cap on a container of tennis balls.

FIG. 1 illustrates an isometric view of the combination 2 of a racquet string aligner mounted as the cap on a container of tennis balls. As seen in FIG. 1, the racquet string aligner 4 is circular and is mounted as a cap on a conventional tennis ball container 6 which typically contains three tennis balls. Tennis balls are typically sold in the marketplace in clear plastic containers which hold a trio of new tennis balls under compressed air pressure. Containers holding four or five tennis balls are also available. The aligner 4 is connected by a skirt 14, which can have threads, ridges, or some other conventional fastening mechanism on the interior walls thereof, adapted to fit with a corresponding set of threads, or similar matching fastening device, formed in the top outer rim of the tennis ball container 6. The threads or fastening means are conventional and are not shown.

The top surface 8 of the aligner 4 is flat and has distributed thereon, in five parallel rows, a series of aligner projections 10. These projections take up only a portion of the surface area of top 8 of the aligner 4. A space 12 is left on the top 8 adjacent the rows of projections 10 to permit the display of a trade-mark, or some other distinguishing indicia of the manufacturer. Fewer rows of projections can be used so long as the purposes of the invention are met.

Figure 2:
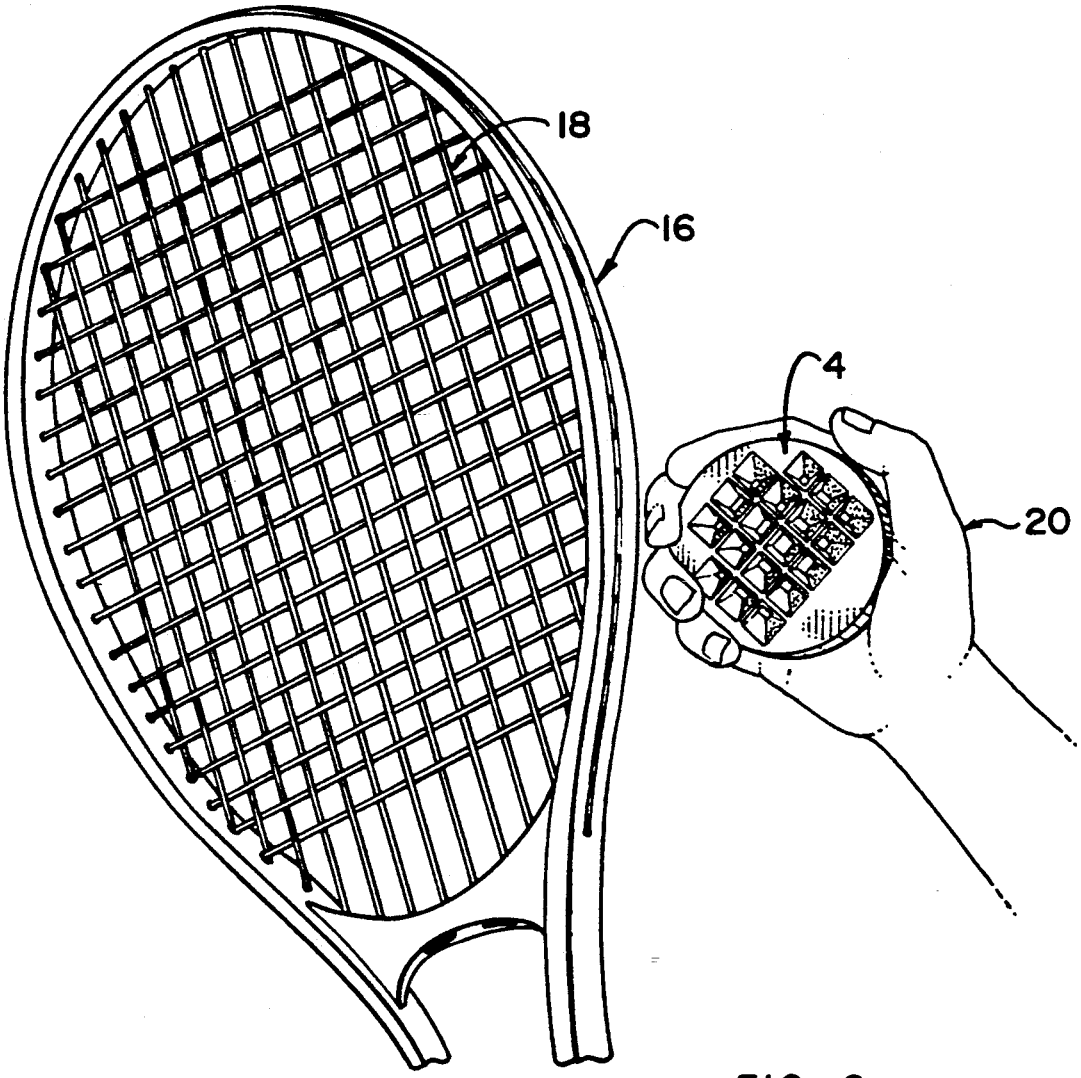
FIG. 2 illustrates a racquet string aligner held in the hand ready for use in aligning the strings of a tennis racquet.

FIG. 2 illustrates a circular racquet string aligner 4 held in the hand of a person ready for use in aligning the strings of a tennis racquet 16. FIG. 2 illustrates the manner in which the circular aligner 4 is of palm size and can be held easily in the hand 20 of a tennis player (not shown) or someone else wishing to align the strings 18 of a typical tennis racquet 16. The spacing between the strings 18 of a typical tennis racquet can vary. Two common sizes available in the marketplace have 11 mm (approx. .4 in.) or 13 mm (approx. 0.5 in.) spacing between the strings. The spacing and topographical shape of the string spacing projections 10 on the aligner 4 are designed to accommodate either 11 mm or 13 mm string spacing, or other conventional string spacings as well.

Figure 3:
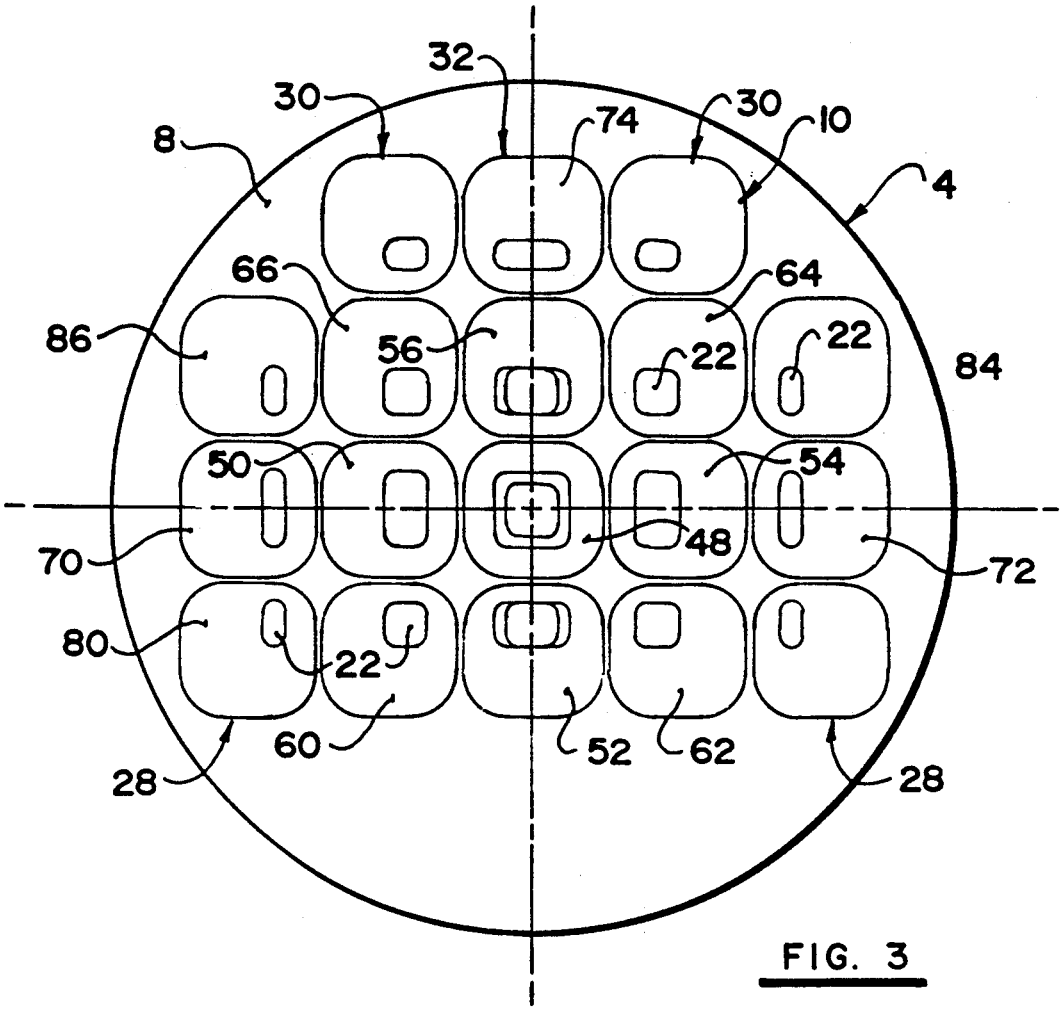
FIG. 3 illustrates a plan view of a racquet string aligner with five parallel rows of rounded corner string aligning projections.

FIG. 3 illustrates a plan view of a circular racquet string aligner 4 with five parallel rows of rounded corner string aligning projections across the aligner 4. The string aligning projections 10 illustrated in FIG. 3 have a generally rounded corner square configuration. The rounded corners minimize racquet string fraying or wear. The projections are arranged in five basic parallel rows (vertical as seen in FIG. 3) in a symmetrical pattern along a centre-line indicated by the dotted line in FIG. 3. The topographical shapes of the projections 10 are not alike and are not typically conical or pyramidal shaped. Each projection varies in topography as indicated by the elevation lines 22. A space 12 on the top surface of the aligner 4 below the projections 10 can be used to display a trade-mark or some other suitable indicia of the manufacturer of the aligner, or of the tennis balls.

As seen in FIG. 3, and looking at it horizontally, the aligner 4 has two outer rows 28, with three projections 10 in each row. Two intermediate rows 30 comprising four projections 10 in each row are positioned adjacent the trio of projections 10 comprising the two outer rows 28. A central row 32 comprising four projections 10 is arranged in a row between the two adjacent intermediate rows 30. A total of eighteen projections are systematically spaced in five rows on the aligner 4. The projections have a specific topographical shape (as indicated by elevation lines 22) according to their grid position on the flat top surface of the aligner 4. The projection in the symmetrical centre of the aligner 4, that is, the second projection 48 from the bottom in centre row 32, has a relatively symmetrical shape and projects straight upwardly from the flat surface. The other projections have an angled outer slope (as determined from the centre projection 48) and give the appearance of "leaning" to the centre of the aligner 4. The projections in the outer rows have the smaller degree of slope to the outer face, determined according to the internal angle bounded by the base of the aligner 4 and the outer slope of the projection 10.

The topography and degree of slope of the outer side of each respective projection 10 is determined by the distance (radius) each projection is from the central projection 48, which is the projection located at the intersection of the two right angle centre-lines shown in FIG. 3. For instance, the tops of the four projections 50, 52, 54 and 56 located immediately adjacent the centre projection 48 are located at a first common radius from the centre projection 48. This first radius is less than the radius to the centre of the base of each projection in this group. Likewise, the tops of the four projections 60, 62, 64 and 66 are located from the centre projection at a second common radius, which is somewhat greater than the first radius. The second common radius is less than the radius of the centre of the bases of this group of projections 60, 62, 64 and 66 to an extent which is greater than the difference between the relative radius of the tops and bases of the first group of projections 50, 52, 54 and 56. In similar fashion, the tops of the projections 70, 72 and 74 are located at an even greater third common radius from the centre projection 48. Again, this radius is less than the common radius of the centre of the bases of this group to a greater extent than the relative ratios for the first and second groups. The tops of the outer group of projections 80, 82, 84 and 86 are positioned at an even greater fourth radius from centre projection 48 with an even greater disparity between the radius to the top and the radius to the centre of the bases of this last group.

It will be noted that since the bases of each projection 10 are equally spaced according to a grid pattern, the foregoing arrangement has the effect of providing a sloping outer surface for each projection that varies according to the degree of distance (radius) that the projection is from the centre projection 48. The smaller the radius, the greater is the proportional degree of slope of the outer side of the projection, measured according to the internal angle bounded by the base 4 and the outer surface of the projection 10. This arrangement permits the different projections 10, with different degrees of slope of the outer surfaces to accommodate different string spacings at different common elevations, as will be explained below in association with FIG. 4.

Figure 4:
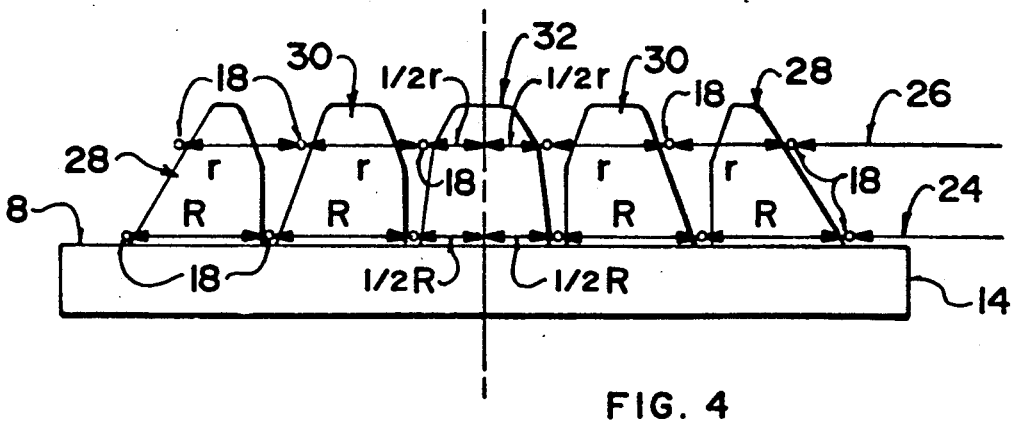
FIG. 4 illustrates a side view of the string aligner illustrated in FIG. 3.

FIG. 4 illustrates an end view of the aligner 4. The different degrees of relative slope of the outer surfaces of the three rows of projections comprising two outer rows 28, two intermediate rows 30, and a centre row 32, is apparent. The degree of slope of the outer surfaces to the centre is smallest in the two outer rows 28. The degree of slope of the outer surface is smaller in the two intermediate rows 30. These different degrees of outer slope are designed to enable the aligner 4 to accommodate different spacings of racquet strings. If the racquet has typical 13 mm (approx. 0.4 in.) string spacing, the strings 18 (shown in dots at the bases of the projections on FIG. 4) will fit precisely in the spaces provided at the bases of the two outer rows of projections 28, the two rows of intermediate projections 30, and the single centre row of projections 32. The width of the bases of each projection is indicated by R. The centre row of projections has a width of $\frac{1}{2}R \times 2$ measured from the centre-line of the aligner 4.

The 13 mm string spacing elevation is indicated by reference number 24, while the 11 mm string spacing elevation is indicated by reference numeral 26, in FIG. 4. If the racquet has 11 mm string spacing between the strings, then the strings 18 will contact the outer walls of the sloped projections 28, 30 and 32 at a higher elevation 26 and be moved into alignment by the contacted outer sloping walls of the projections. At the upper common elevation 26 indicated by the 11 mm spaced strings, the dimension between each string is denoted as "r", with the dimension of the central projections 32 denoted by $\frac{1}{2}r \times 2$, as determined from the centre-line. The radius "r" at the upper 11 mm string spacing level 26 is naturally less than the radius "R" of the lower 13 mm string spacing level 24. Laterally, and longitudinally, "r" would equal 11 mm (approx. 0.4 in.) and "R" would equal 13 mm (approx. 0.5 in.). The centre position of the bases 24 of each projection are located respectively at the centre-line, a first radius R ($\frac{1}{2}$R of the first projection 32 plus $\frac{1}{2}$R of the second projection 30) and a second radius (which is $2R = \frac{1}{2}R$ plus R plus $\frac{1}{2}R$) measured from the centre-line.

The fact that "r" is proportionately less than "R", as judged by respective racquet string spacing (smaller string spacings are handled at higher elevations on the projections) means that the angle of slope of the outer wall of each projection is smaller the greater the distance that the projection is from the central projection. Different spacings between the strings will thus be accommodated at different elevations of the uniquely shaped and angled outer, intermediate and centre rows of projections 28, 30 and 32.

Figure 5:
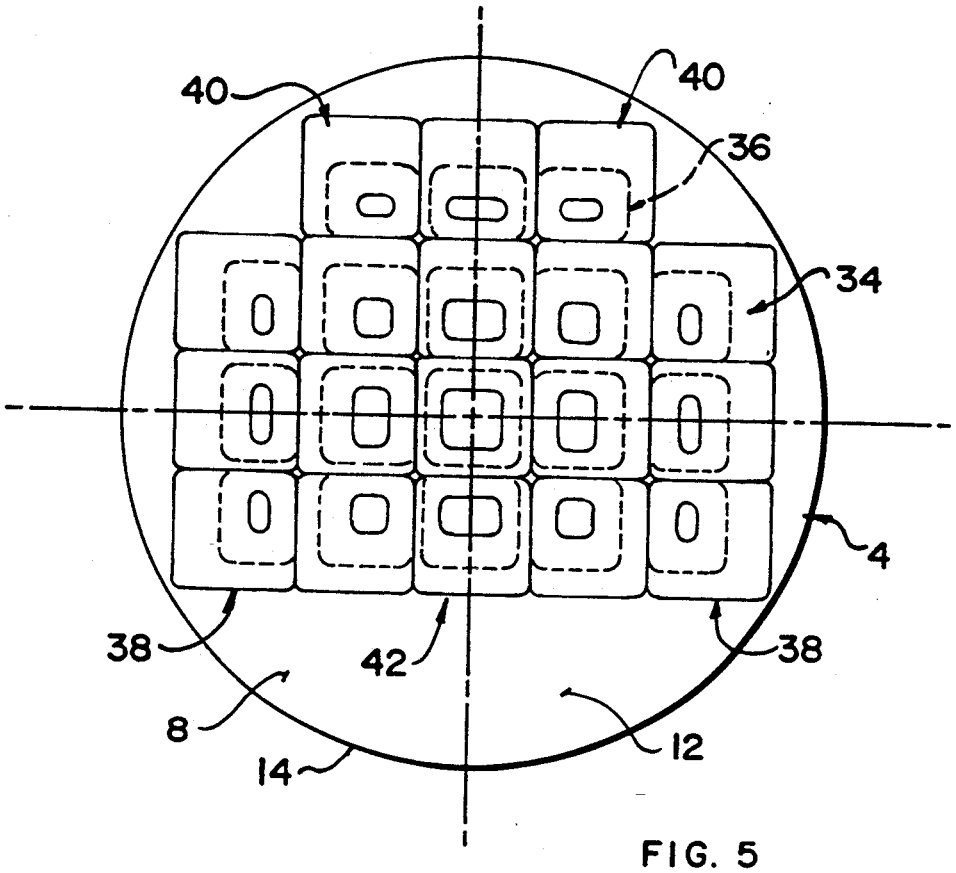
FIG. 5 illustrates a plan view of a racquet string aligner which has five rows of square based parallel string aligning projections.

FIG. 5 illustrates a plan view of a racquet string aligner which has square based parallel leaning rows of string aligning projections. The shape of the projections 34 as indicated in FIG. 5 has a generally square base, slightly rounded corner configuration. The slopes of the projections are indicated by the dotted and solid elevation lines 36. As with the previous design of aligner 4 illustrated in FIGS. 3 and 4, there are five parallel rows of projections, two outer rows 38 comprising three projections in each respective row, two intermediate rows 40 of four projections in each respective row, and a centre row 42 comprising four projections. Each projection has a specifically designed topography according to the radius principle previously described to accommodate different string spacings. The slope of the outer surfaces of the projections is generally symmetrical along the centre-line indicated by the dotted line in FIG. 5. The degree of slope of the projections is also symmetrical along a centre-line drawn at right angles to the centre-line shown in FIG. 5.

Figure 6:
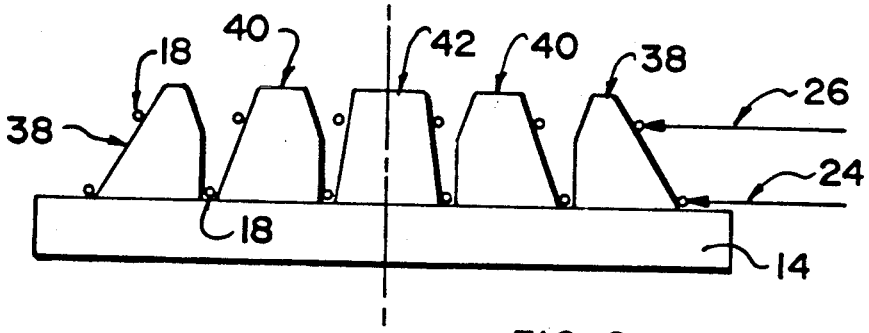
FIG. 6 illustrates a side view of the string aligner illustrated in FIG. 5.

FIG. 6 illustrates an end view of the aligner 4, as shown in FIG. 5, illustrating how the two outer rows of projections 38, the two intermediate rows of projections 40, and the centre row of projections 42 are arranged on the top surface of the skirt 14, the outer walls of the two outer rows 38, and the two intermediate rows 40, sloped in the direction of the centre row 42, in the same manner as discussed previously with respect to FIGS. 3 and 4. If the racquet has 13 mm spacing between the strings 18, then the strings 18 will fit between the spaces provided by the projections 38, 40 and 42 at the base elevation indicated by reference numeral 24. If the strings 18 of the racquet have 11 mm spacing, then the slanted shapes of the projections 38, 40 and 42 will cause the strings 18 to be engaged by the outer slope of each projection at the mid-elevation indicated by reference numeral 26. Other sizes of string spacing will be accommodated at different elevations of the projections.

Figure 7:
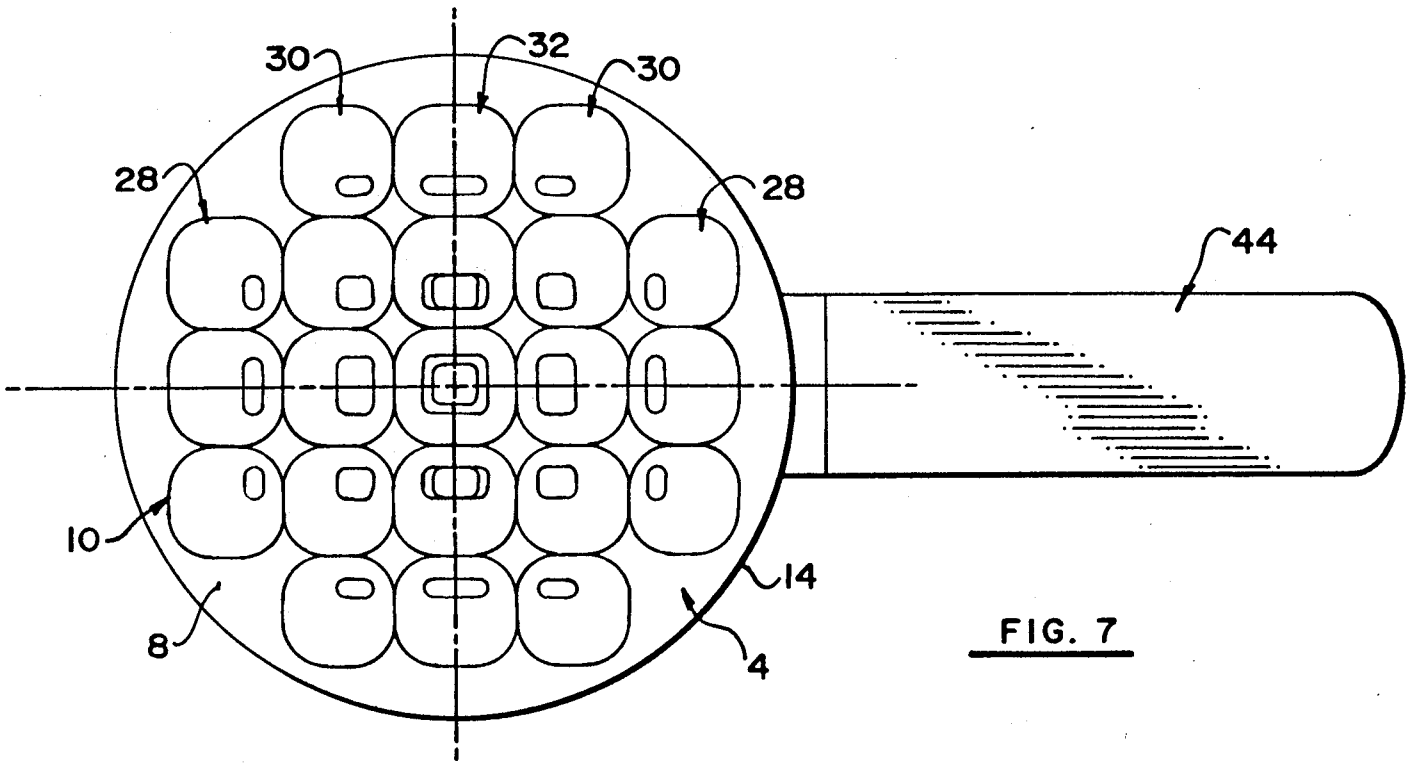
FIG. 7 illustrates a plan view of an alternative design of racquet string aligner with a grip tab attached to the aligner.

FIG. 7 illustrates a plan view of an alternative design of racquet string aligner with a grip tab attached to the aligner. The alternative design of aligner 4 illustrated in FIG. 7 has an extra pair of intermediate projections 30 and an extra centre projection 32 in the respective rows, making five projections in each of the intermediate rows and five projections in the centre row. This eliminates the display space 12 which was present in the aligner design illustrated in FIGS. 3, 4, 5 and 6. In other respects, the design and topography of the projections in the aligner are similar to those illustrated and discussed previously in FIGS. 3 and 4. The angle of slope for the outer walls of the various projections is determined according to the radius principle previously discussed and is generally symmetrical about the vertical centre-line shown in FIG. 7, and the horizontal centre-line as seen in FIG. 7.

Figure 8:
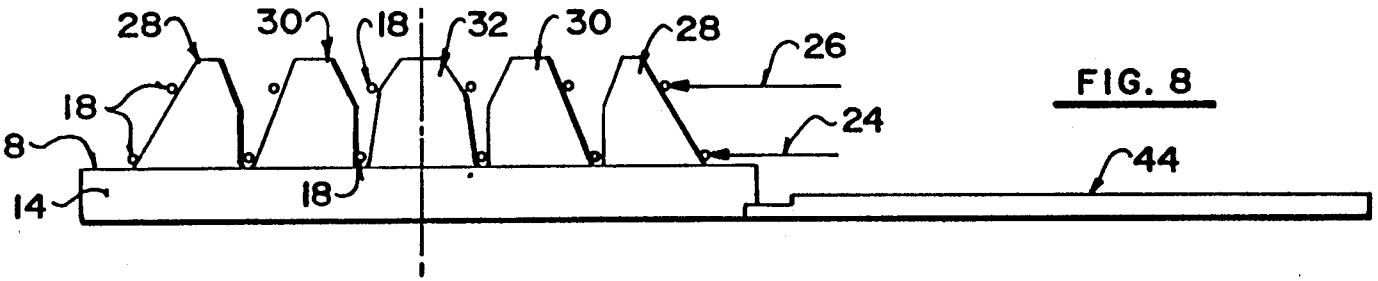
FIG. 8 illustrates a side view of the racquet string aligner illustrated in FIG. 7.

FIG. 7 illustrates a grip tab 44 which is secured to one side of the skirt 14 (as also shown in FIG. 8). This grip tab 44 can be molded in one-shot along with the aligner in a conventional injection mold. This grip tab 44 enables the user to grip the aligner and pull it free from the top of the can 6 (see FIG. 1). The grip tab 44 is typically constructed of the same flexible material as the aligner. The aligner can be injection molded from a flexible polymer such as polyethylene, polyvinyl chloride, or polypropylene, and can be gripped by the hand to facilitate using the aligner to adjust the alignment of the racquet strings 18. Alternatively, the aligner can be formed of a rigid plastic such as polyacrylate or polyester.

FIG. 8 illustrates a side view of the alternative embodiment of the aligner illustrated in FIG. 7. The topography of the two outer rows of projections 28, the two intermediate rows of projections 30 and the central row of projections 32 is similar to the topography of the projections illustrated in FIGS. 3, 4, 5 and 6. The concept of accommodating 13 mm spacing strings 18 at the base of the projections, and tighter 11 mm spacing strings 18 at a higher elevation, is fundamentally the same.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A racquet string aligner for aligning the strings of a racquet comprising:

(a) a base member;

(b) a tapered central projection on the base member having a topography that tapers away from the base member;

(c) at least one tapered first projection adjacent the central projection the base of which is located at a first radius from the centre-point of the central projection, and at least a portion of a string impinging surface of which has a first slope in the direction of the central projection; and (d) at least one tapered second projection the base of which is located at a second radius from the centre-point of the central projection greater than that of the first radius, at least a portion of an outer surface of which slopes in the same direction as the slope of the first projection in the direction of the central projection to a degree smaller than the first slope.

2. An aligner as claimed in claim 1 including at least one tapered third projection the base of which is located at a third radius from the centre-point of the central projection greater than the second radius and at least a portion of an outer surface of which slopes in the same direction as the slopes of the first and second projections in the direction of the central member to a degree smaller than the slope of the second projection.

3. An aligner as claimed in claim 2 wherein the base member is circular.

4. A racquet string aligner for aligning the strings of a racquet to provide even spaces between the strings comprising:

(a) a circular base member;

(b) a central row of first projections extending upwardly from the base along a centre-line of the circular base member, said projections having a tapered configuration extending upwardly from the base;

(c) a pair of rows of second projections extending upwardly from the circular base member and distributed parallel to and in spatial arrangement on either side of the central row of projections and the centre-line of the circular base member, said pairs of rows of second projections having tapered configurations extending upwardly from the base, and outer slopes beginning at the base and extending upwardly and spaced away from the first projections, the outer slopes of the second projections slanting in the direction of the centre-line, to accommodate racquets with smaller string spacing while the bases of the projections accommodate racquets with larger string spacing, a pair of rows of third projections extending upwardly from the circular base member being distributed parallel to and in spatial arrangement with the pair of rows of upwardly extending second projections, and disposed on the sides of the respective rows of second projections, opposite the central row of first projections, said pairs of rows of third projections having tapered configurations extending upwardly from the base, the five rows of upwardly extending first, second, and third projections having outer sides which slope to the centre area of the circular base member and thereby proportionately accommodate at different elevations along the slopes of the projections racquet strings of progressively smaller spacings, the central row of first projections having four projections in the row, the two intermediate rows of second projections having four projections in each row with outer slopes leaning toward the centre-line to a first degree, and the two outer rows of third projections having three projections in each row with outer slopes leaning toward the centre-line to a degree smaller than the first degree.

5. An aligner as claimed in claim 4 wherein the circular base has extending downwardly therefrom around its periphery a skirt which is adapted to releasably engage with the top rim of a hollow cylindrical container adapted to hold at least one tennis ball.

6. An aligner as claimed in claim 5 wherein the upwardly extending projections have rounded corner square bases, the two outer rows of third projections are slanted upwardly and inwardly in the direction of the centre row of first projections, and the two intermediate rows of second projections are slanted upwardly and inwardly in the direction of the centre row of first projections, but at a greater angle of slope than the slope of the two outer third projections.

7. An aligner as claimed in claim 6 wherein the bases of the upwardly extending projections are square.

8. An aligner as claimed in claim 5 wherein an elongated tab is connected to one side of the periphery of the skirt extending downwardly from the circular base member.

9. A racquet string aligner and tennis ball container lid combination comprising:

(a) an aligner as claimed in claim 5; and (b) a hollow cylindrical container adapted to contain tennis balls, the top rim of the hollow cylinder being adapted to releasably engage with the skirt of the circular base of the aligner.

10. A combination as claimed in claim 9 wherein the circular base of the aligner has threads therein which are adapted to releasably engage with mating threads around the top rim of the hollow cylindrical container.

11. An aligner as claimed in claim 4 wherein the walls of the projection at the centre-point of the aligner in the first row of projections slopes symmetrically and inwardly along an axis extending vertically from the circular base member, and the outer walls of the first projections on either side of the central symmetrical projection slope inwardly in the direction of the central symmetrical projection.

* * * * *